United States Patent [19]

Cerroni

[11] Patent Number: 4,489,896

[45] Date of Patent: Dec. 25, 1984

[54] PROCESSING APPARATUS FOR SOLID URBAN REFUSE AND PLASTIC BAGS FILLED WITH SAME

[76] Inventor: Manlio Cerroni, Via Bruxelles, 51, 00198 Roma, Italy

[21] Appl. No.: 480,277

[22] Filed: Mar. 30, 1983

[51] Int. Cl.[3] ..... B02C 18/22

[52] U.S. Cl. ..... 241/36; 241/88.4; 241/89.3; 241/167; 241/190; 241/243; 241/DIG. 38

[58] Field of Search ..... 241/DIG. 38, 190, 242, 241/243, 87.1, 88.4, 89.3, 95, 236, 166, 167, 36

[56] References Cited

U.S. PATENT DOCUMENTS 3,981,455 9/1976 Kaczmarek ..... 241/DIG. 38 X
4,039,150 8/1977 Ivarsson ..... 241/190 X

FOREIGN PATENT DOCUMENTS 8868 1/1978 Japan ..... 241/190

*Primary Examiner*—Mark Rosenbaum
*Attorney, Agent, or Firm*—Watson, Cole, Grindle & Watson

[57] ABSTRACT

A processing apparatus for cutting solid refuse and for breaking open any bags in which the solid refuse is contained comprises a housing which has an inlet opening and an outlet opening; a rotary shaft mounted in the housing, the rotary shaft mounting a plurality of blade elements which include head portions with cutting edges that extend radially away from the rotary shaft, the head portions of the blade members forming spaces therebetween and being sequentially angularly oriented about the shaft; and a plurality of parallel slat blades stationarily mounted in the housing, each slat blade being aligned with a space between the head portions of the blade elements and shaped so that material fed into the inlet opening of the housing will be compacted and/or crushed and cut by the coaction of the blade element head portions and the slat blades, and then discharged from the housing outlet opening.

5 Claims, 2 Drawing Figures

PROCESSING APPARATUS FOR SOLID URBAN REFUSE AND PLASTIC BAGS FILLED WITH SAME

BACKGROUND OF THE INVENTION

1. Field of the Invention

The present invention relates to processing apparatus for solid urban trash or refuse, and more specifically to processing apparatus which is capable of cutting or tearing solid refuse, especially plastic or plasticized bags containing the solid refuse, preliminarily to sorting of the solid refuse for recycling purposes.

2. The Prior Art

Over the past few years the popularity in urban areas of storing trash and solid domestic refuse in plastic or plasticized bags has increased drammatically. These bags, which may be in each case more or less filled with the solid domestic refuse, are conventionally left outside dwellings for pickup by public or private trash collectors, and these trash collectors will place the bags in their trucks and ultimately transport them to recycling plants for processing, sorting and recycling treatments.

Once at the recycling plant the bags containing the solid refuse must be broken open and their contents sorted, i.e., because the contents will include many different types of materials, e.g., smaller bags, boxes, cans, etc., which must be treated differently during recycling. Actually, automatic systems for opening bags containing solid refuse are difficult to construct, principally because any apparatus must accomodate for vast differences in shapes and hardnesses of materials which can be anticipated to be contained in the bags.

One apparatus for processing bags containing solid urban refuse is shown in U.S. Pat. No. 3,891,105. In this apparatus a series of spikes is used to hold each bag, these spikes cooperating with corresponding blades to provide a series of longitudinal tears or cuts in the treated material. However, the alternating motion utilized in this device limits the range of movement of the elements and thus a complete opening (cutting) is never obtained. This produces problems in the subsequent shearing operation because material is still left untouched in sections of the bags. In addition, this device fails to operate in a satisfactory way because there are two groups of blades and counteractive blades operating independently, the counteractive blades holding the refuse material to be sheared in a fixed position while the blades advance in the same direction and more quickly than the underlying conveyor, thus dragging the refuse material against the counteractive blades, each of which makes a tear, the counteractive blades being somewhat free in the cutting operation and the blades in the return mode. Moreover, the counteractive blades are in positive control only during the lift operation and their weight is what makes them operate in the lowering phase, while the blades are in a positive control during both operations. This device has thus proved to be overly permissive—the counteractive blades may easily retract when meeting objects having a certain resistance. The result is an irregular operation and frequent stoppages of operation of the apparatus.

Another known apparatus involves a high speed mill using fixed or articulated hammers or flexible whips attached to high speed rotors which are kept taut by centrifugal forces. However, this apparatus is not entirely desirable because it operates on the materials so vigorously that subsequent recovery of the cut materials into the desired categories is very difficult.

The present invention is directed to a process and apparatus which will operate to break open the bags containing the solid urban refuse and will also operate to compact and shear or cut the contained refuse, e.g., the boxes, plastic items, wood items, etc., which may be contained therein, so that the solid refuse can then be easily sorted out into the desired categories and further processed as necessary.

SUMMARY OF THE INVENTION

The process to break open bags containing solid urban refuse according to the invention consists basically in pushing the material to be sheared or cut forward along a type of platform made up by the tops of spaced apart slat blades positioned within a housing, the platform forming a flattened spiral surface extending from the side of the housing toward a shaft which mounts cutting blades. According to the invention the cutting blades are mounted on the shaft so as to be movable between adjacent slat blades and the material to be processed is pushed forward on the tops of the slat blades, and due to their spiral curvature, the material will become compacted. Thereafter it is broken open by coaction of the cutting blades moving past the slat blades. The sheared material then falls between the spaces left between the adjacent slat blades and, after collection, moves on for further treatments.

According to the inventive process, the cutting blades coacting with the slat blades sequentially reach the proper position to cut or shear the material, thereby reducing the force required for this operation, and if the cutting blades meet with a resistance greater than that set beforehand, a special means enables their direction of rotation to be reversed in order to free the space between two adjacent slat blades and then reset the device into standard operation once again.

As indicated, the apparatus is constituted by a shaft carrying cutting blades in an angularly offset arrangement, the cutting blades being rigidly attached to the shaft, which by rotation of the shaft perform the cutting operation. During this rotational movement the cutting blades penetrate between a series of fixed slat blades, forcing the material to pass through the slits constituted by the spaces between the slat blades.

One result provided by the rotational motion of the shaft mounting the cutting blades which is not achieved with other systems is the elimination of the unproductive (dead) return operation, thereby saving the time required for such an operation.

Compared to the other systems, therefore, the inventive processing apparatus has the capacity to receive a greater quantity of material to be processed.

The apparatus is operable with the shaft rotating at a slow speed, ensuring that the material does not come into contact more than once with the cutting blades and slat blades, and is instead moved beyond the slat blades immediately, thereby preventing complete destruction of the refuse material, such that it cannot be thereafter sorted easily.

Setting the present apparatus apart from similar ones with high speed rotors is the size of the slat blades, their shape, their placement, the shape of the slat blades, and the structure of the entire apparatus, which permits unprocessible materials to be expelled.

The size of the cutting blades is specially controlled so as to allow large items to be introduced into the apparatus without the assistance of other push devices. The large opening created at every turn between the cutting blades and the fixed part of the structure is such that it permits cumbersome elements to be grasped and dragged toward the slat blades.

The shape of the cutting blades is strictly in correspondence with the shape of the slat blades so as to minimize the effort of the machine to expel foreign elements by reversing, as indicated, the direction of rotation of the shaft.

As indicated above, the cutting blades are arranged in an angularly offset fashion about the shaft on which they are mounted—so that only one blade at a time performs its task, thus making it possible to absorb all the power needed to crush and cut the more resistant bodies.

The cutting blades perform well because the slat blades have a special, spiral profile to drag the material to be crushed toward the center of the shaft axis, and is thereby forced to move across the slat blades. This system reduces the force levers developed at the time of cutting, thereby significantly reducing torque on the shaft axis. This precaution permits very long cutting blades and eliminates the need for cutting forces applied to their extremities, which would result in extremely high levels of torque at specific moments.

The shape of the cutting blades in conjunction with the device for reversing the direction of rotation of the shaft enables hard and uncrushable materials to be removed from the cutting area, and for them to be brought over the shaft and discharged directly onto the area below.

A better understanding of the present invention will be achieved by reference to the attached drawings, taken in conjunction with the following discussion.

DETAILED DESCRIPTION OF THE PREFERRED EMBODIMENT

Figure 1:
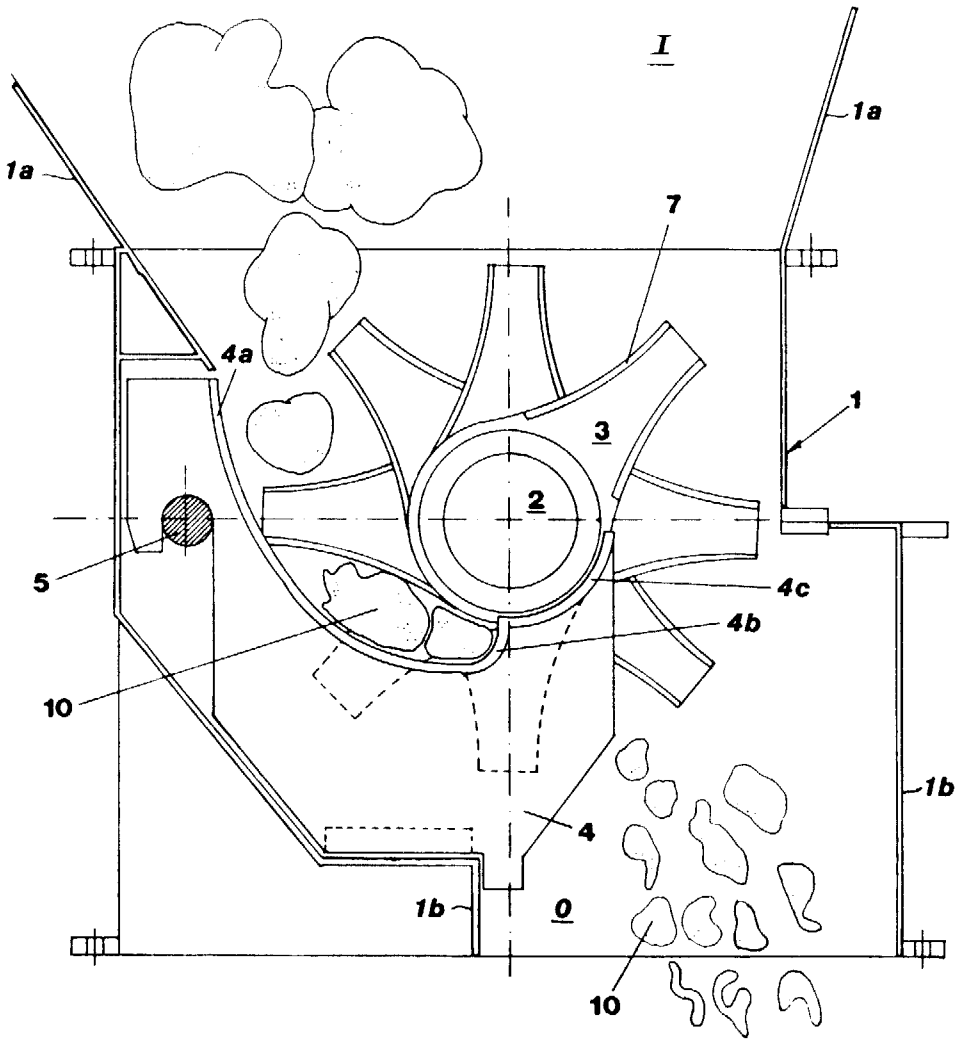
FIG. 1 shows a schematic side view of a processing apparatus constructed in accordance with the present invention.
Figure 2:
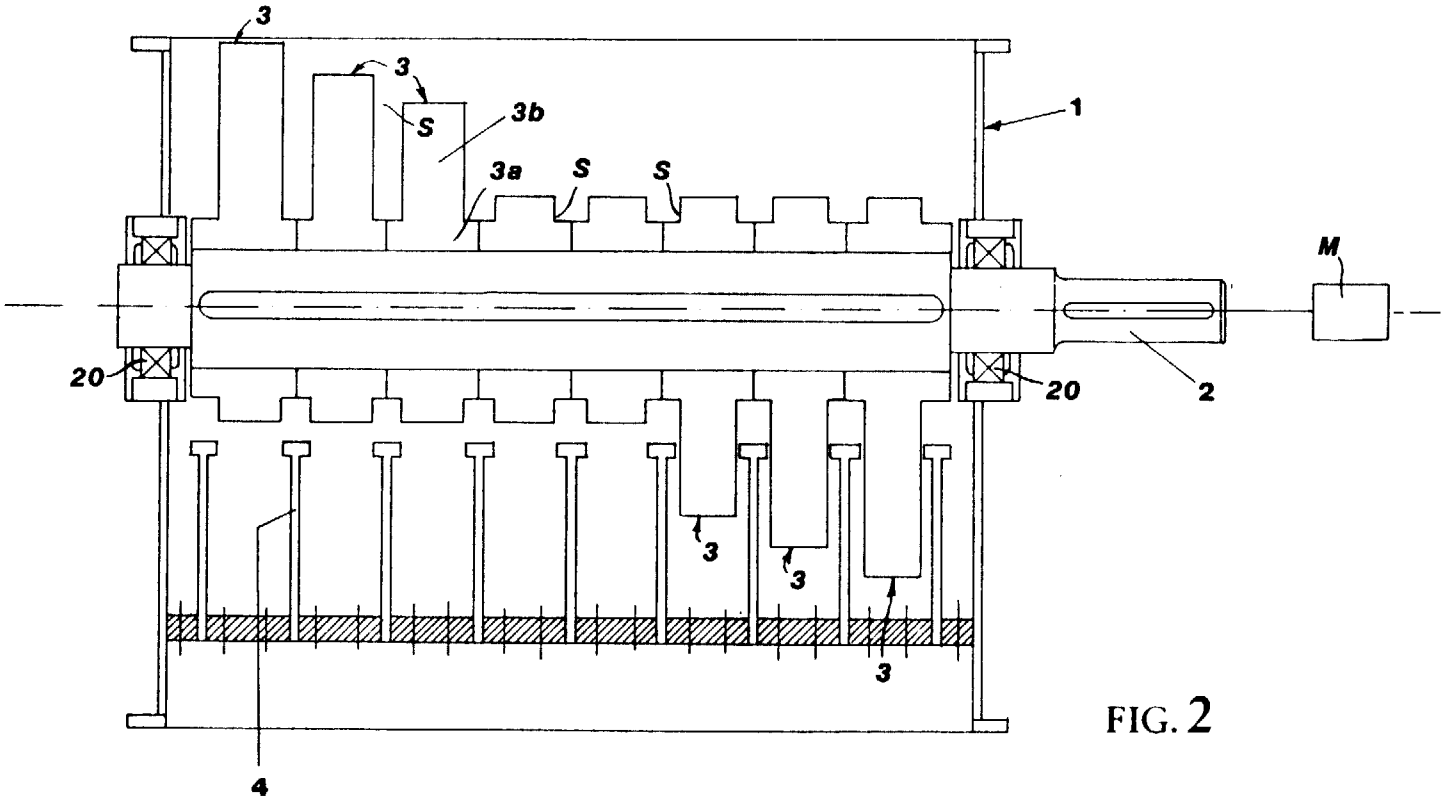
FIG. 2 shows a schematic front view of the processing apparatus shown in FIG. 1.

As seen in FIGS. 1 and 2, the processing apparatus according to the present invention includes a housing 1, a shaft 2 which is rotatably mounted in the housing, and a plurality of parallel slat blades 4 which are stationarily mounted within the housing in a spaced apart fashion across its width. The shaft 2 mounts a plurality of blade members 3 which are positioned to cooperate with the slat blades 4 to compact and cut solid refuse which is supplied to the housing 1.

Considering the basic elements of the apparatus in greater detail, the housing 1 is constructed to have an inlet opening I formed by upper walls 1*a* at its upper end and an outlet opening O formed by lower walls 1*b* at its lower end. As shown in FIG. 1, the outlet opening O of the housing is offset forwardly (to the right) with respect to the inlet opening I.

The shaft 2 is mounted in bearings 20 which are located in the lateral sides of the housing 1 so as to be positioned between the inlet opening O and outlet opening I, and it is driven in either clockwise or counter-clockwise (as seen in FIG. 1) fashion by a drive means M. The blade members 3 are mounted along the shaft 2 in a side-by-side relationship and they include base portions 3*a* which surround the shaft 2 and are fixedly attached thereto, and head portions 3*b* which extend radially away from the base portions 3*a* and are somewhat narrower in width, i.e., so as to provide lateral spaces S therebetween (see FIG. 2). The head portions 3*b* have opposed front and rear surfaces which converge towards the topmost end of the head portion and define cutting edges which are reinforced with a hard material 7. As seen in FIG. 1, the blade members 3 are positioned about the shaft 2 such that their head portions are sequentially angularly oriented about the shaft.

The stationary slat blades 4, which are removably mounted in the housing by way of a bolt 5 that extends across the width of the housing, are spaced apart so as to be aligned with spaces S between the head portions 3*b* of the blade members 3. Each slat blade has an enlarged upper edge formed of a hard material which is shaped to provide a first curved portion 4*a*, a second curved portion 4*b* and a third curved portion 4*c*. The first curved portion 4*a* of each slat blade is shaped to form a smooth, flattened spiral surface which extends from a point adjacent the rear wall 1*a* of the inlet opening I of the housing to a point beneath the rotary shaft 2, the second curved portion 4*b* extends abruptly upwardly from the end of the first curved portion beneath the rotary shaft to a point nearer the shaft, and the third curved portion 4*c* extends around a portion of the shaft (acctually around the base portions of the associated blade members) from the end of the second curved portion 4*b* nearest the shaft.

When the inventive processing apparatus is in use, solid refuse 10 (including any bags in which the solid refuse may be contained) is deposited into the inlet opening I of the housing 1 so as to fall onto the first curved portions 4*a* of the slat blades 4, and due to the rotation of the shaft 2 (counter clockwise in FIG. 1), the action of the blade members 3 and the shape of the first curved portion 4*a*, the solid refuse will move along the first curved portions 4*a* and abut against the second curved portions 4*b*, the solid refuse in the meantime becoming compacted and crushed, and then it will be cut by the cutting edges of the head portions 3*b* as blade members 3 pass downwardly between the slat blades 4. The cut refuse will then fall downwardly between the slat blades and will be discharged from the housing by gravity through the outlet opening O at the lower end of the housing. The very close spacing which is provided between the third curved portion 4*c* of the slat blades 4 and the base portions 3*a* of the blade members 3 will prevent long, fibrous materials such as rags, plastic, rope, etc., from becoming wrapped or jammed about the shaft 2 and its hub and thus result in a shutting down of the apparatus.

Because the cutting of the solid refuse will be achieved by the head portions 3*b* of the blade members near the base portions 3*a* and because the head portions 3*b* will come into cutting contact with the solid refuse in a sequential fashion (as a result of their sequential angular orientation about the shaft 2), the inventive processing apparatus will operate satisfactorily with the shaft 2 rotating at a relatively slow speed, e.g., 10 to 15 turns per minute. Thus, the inventive processing apparatus will be inexpensive to operate, and because the apparatus is simple in construction, it will be inexpensive to manufacture.

The drive means M used to drive the shaft 2 can include a torque meter or an overpressure device to enable the drive means to reverse, when necessary, the direction of rotation of the shaft 2. Such a reverse rotation, continued for 2 or 3 revolutions of the shaft 2, will cause refuse materials which cannot be cut to be moved backwardly along the first curved portions 4*a* of the slat blades 4 and then up and over the shaft 2 so as to fall through the outlet opening O of the housing 1 and to accumulate with the refuse which has been previously sheared.

The drive means M can then be reversed in operation to again rotate the shaft 2 in its normal (counterclockwise in FIG. 1) direction.

Various obvious changes in the elements of the invention as described above can be made and yet still fall within the scope of the appended claims.

I claim:

1. A processing apparatus capable of compacting and cutting material in the form of solid refuse and the bags in which the solid refuse may be contained, said process apparatus comprising a housing having an inlet opening and an outlet opening, a shaft rotatably mounted in said housing, said shaft fixedly mounting a plurality of blade members which include head portions which extend radially away from the shaft and which have cutting edges, the head portions of the blade members defining spaces therebetween and being sequentially angularly oriented about the shaft, a platform formed by a plurality of parallel slat blades stationarily mounted in the housing, each slat blade being aligned with a respective space between the head portions of said blade members, and each slat blade including an upper edge shaped to provide a first, smooth, flattened curved surface portion which extends from the inlet opening of the housing to a point near and beneath said shaft, a second curved surface portion which extends abruptly upwardly from the end of the first curved surface portion beneath said shaft to a point nearer said rotary shaft, and a third curved surface portion which extends around a portion of said shaft from the end of the second curved portion nearest said shaft, the first surface portions of the slat blades causing material which has been fed to said housing through its inlet opening to be supported and to move toward the second surface portions thereof, said second surface portions acting as an abutment for the material, the blade members mounted on said shaft first compacting and then cutting the material as the rotation of said shaft causes said blade members to sequentially move toward and into the spaces between the said slat blades, the cut material falling downwardly to and through said outlet opening, and said third surface portions of said slat blades preventing material from becoming wrapped or jammed about said shaft, and drive means connected to said shaft to slowly rotate it in a direction such that said blade members thereon compact and cut material in cooperation with said slat blades and upon sensing the presence of material which cannot be cut, will reverse the rotation of said shaft, causing the blade members thereon to lift the material which cannot be cut up and over said shaft and then drop it downwardly to and through said outlet opening.

2. The processing apparatus as defined in claim 1 wherein the head portion of each blade member has curved front and rear surfaces which converge towards one another as they extend radially away from said shaft.

3. The processing apparatus as defined in claim 1 wherein each of said slat blades is removably mounted within said housing.

4. The processing machine as defined in claim 3 wherein said housing includes a bolt mounted therein which extends in parallel with said shaft, and wherein said slat blades are mountable on said bolt.

5. The processing apparatus as defined in claim 1 wherein each of said blade members includes a base portion which surrounds said shaft and is fixedly attached thereto, wherein the head portion of each blade member extends radially away from its respective base portion, and wherein the third surface portions of said slat blades extend around portions of the base portions of adjacent slat blades.

* * * * *